United States Patent [19]

Rivolo

[11] 4,014,304

[45] Mar. 29, 1977

[54] INJECTION PUMPS FOR DIESEL ENGINES

[75] Inventor: Pier Franco Rivolo, Turin, Italy

[73] Assignee: Fiat Societa per Azioni, Turin, Italy

[22] Filed: June 24, 1975

[21] Appl. No.: 589,812

[30] Foreign Application Priority Data

Sept. 2, 1974 Italy ..... 69666/74

[52] U.S. Cl. ..... 123/139 E; 123/139 BD; 123/140 FG

[51] Int. Cl.[2] ..... F02M 37/00

[58] Field of Search ... 123/139 E, 139 AB, 139 BD, 123/139 AQ, 139 E, 140 FG

[56] References Cited

UNITED STATES PATENTS

| | | | |
|---|---|---|---|
| 2,431,516 | 11/1947 | Starr | 123/140 FG |
| 2,879,467 | 3/1959 | Stern | 123/140 FG |
| 3,444,849 | 5/1969 | Bessiere | 123/140 FG |
| 3,587,540 | 6/1971 | Hoffmann et al. | 123/139 |
| 3,630,643 | 12/1971 | Stuttgart | 123/139 E |
| 3,661,130 | 5/1972 | Eheim | 123/139 E |
| 3,665,907 | 5/1972 | Laufer | 123/139 E |
| 3,797,469 | 3/1974 | Kobayashi et al. | 123/139 E |

*Primary Examiner*—Wendell E. Burns
*Assistant Examiner*—David D. Reynolds
*Attorney, Agent, or Firm*—Sughrue, Rothwell, Mion, Zinn & Macpeak

[57] ABSTRACT

A diesel engine fuel injection pump with electronic output regulation has an actuator cylinder for controlled displacement of a control rod which regulates a pumping element control screw. This actuator cylinder is machined in the pump body together with a seating for a distributor valve which controls the supply of hydraulic working fluid to the actuator cylinder. The working fluid may be the fuel itself.

6 Claims, 4 Drawing Figures

INJECTION PUMPS FOR DIESEL ENGINES

BACKGROUND OF THE INVENTION

The present invention relates to improvements in injection pumps for diesel engines, with electronic output regulation.

Pumps of this type are already known in which an adjusting screw of at least one pumping element is slidable in a seating machined in the pump body and connected to a feed chamber adapted to receive fuel under pressure from an auxiliary pump, the rotation of the screw being regulated by a control rod which is displaceable longitudinally by proportional electrohydraulic actuator means carried on the pump body, the said actuator means including a distributor valve governed by an electromagnet which controls the feed and exhaust of the fluid under pressure respectively to and from an actuator cylinder containing a piston connected to the control rod, so as to obtain for each value of an electrical command signal from an electronic pump control unit a given position of the said piston and therefore of the control rod.

The desired linear positioning of the piston and therefore of the control rod and the angular positioning of the pumping element are ensured by a detector mounted to one of the said positioning elements. This detector is adapted to produce a feedback signal which is constantly compared with the said command signal so that the electromagnet receives, when the said two signals are equivalent to each other, a signal in response to which the distributor valve assumes a position in which communication between the actuator cylinder and the fluid feed and exhaust respectively is interrupted.

In known injection pumps of the type specified above, the actuator cylinder and the distributor valve are disposed in a housing separate from the pump body in which the pumping element or elements is or are mounted, this housing being fixed to the pump body. The electromagnet is also carried on the said separate housing in which the actuator cylinder and the distributor are located. Such a construction necessitates a mechanical linkage between the control rod and the piston of the hydraulic cylinder, and it is impossible in practice to ensure a perfect concentricity between the seatings in which the rod is guided and the actuator cylinder in which the respective piston slides to control the displacements of the said rod. Such a mechanical linkage between the piston and the control rod is a source of play and friction, as well as of forces perpendicular to the axis of the rod, which forces increase the friction and give rise to a tendency for the rod to stick, particularly when alignment defects exist between the respective seatings and the actuator cylinder. Consequently an effective delivery control may be obtained only with fairly high pressures which may only be obtained with the use of expensive separate hydraulic control units for feeding fluid under pressure to the distributor valve.

Moreover, the pump may be provided with a safety stop device which includes a thrust rod facing the end of the control rod opposite the piston of the actuator cylinder, and is hand operated with servo assistance when the fuel feed pressure at the injection pump inlet drops, to avoid the residual fuel present in the feed chamber from being sent to the injectors with the danger of continuing to rotate the engine in the stopping stage. In this case the separate hydraulic control must also include solenoid valves and the electronic pump control circuit will necessarily be more complicated.

The present invention has the object of avoiding the above-mentioned disadvantages.

SUMMARY OF THE INVENTION

According to the invention there is provided an injection pump for diesel engines of the aforesaid type, characterised in that the actuator cylinder and the seating of the distributor valve are machined directly in the pump body in which the seating or seatings for the pumping element or elements is or are formed, and in that the control rod is attached to the piston of the actuator cylinder.

The present invention achieves a marked compactness and simplicity of construction as regards the mechanical parts of the members which control the pump output, substantially eliminating play and friction. It also becomes possible by means of the invention to control the fuel delivery even at low pressures, with the advantage of being able to use the same fuel fed to the pump as the working fluid for the actuator cylinder, eliminating the need for an expensive separate unit for controlling feeding of such fluid, which would otherwise be necessary to ensure the required working in all conditions of use.

Moreover exact guidance is always ensured for the control rod, both in the case of a pump having a single pumping element in which such rod may project outwardly from the sliding piston of the actuator cylinder, and in the case of a pump with several aligned pumping elements, in which the rod, as well as being fixed to the piston at one end, may be guided at its other end in a seating in the body of the pump. Such a seating may in fact be formed in the course of the same machining operation as the actuator cylinder and the seating of the respective distributor valve. There is therefore excluded all possibility of sticking or seizure in the control rod, rendering the system highly reliable.

According to a preferred characteristic of the invention the distributor valve is supplied with fuel under pressure from the pump feed chamber, or fuel at a pressure commensurate with that in the feed chamber. In this last instance, in the absence of a feed pressure the pressure on the piston of the actuator cylinder also ceases, enabling the action of a safety stop device on the piston itself — an impossibility if the actuator cylinder were to be supplied with pressure, by means of the respective distributor valve, by a pump or separate control unit, unless the structure of the hydraulic circuit and the electronic control circuit were complicated by the insertion of more specialised solenoid valves and the like.

Preferably the conduits which connect the distributor with the feed chamber, with the fuel inlet and with the actuator cylinder are also machined in the pump body. This enables the hydraulic circuit to be designed with few connections to produce the possibility of fluid reaching it at reduced pressures, at the same time lowering the production cost and finally increasing the safety of the operation.

BRIEF DESCRIPTION OF THE DRAWINGS

The invention will be further described, by way of non-limiting example, with reference to the accompanying drawings, in which.

DETAILED DESCRIPTION OF THE ILLUSTRATED EMBODIMENT

Figure 1:
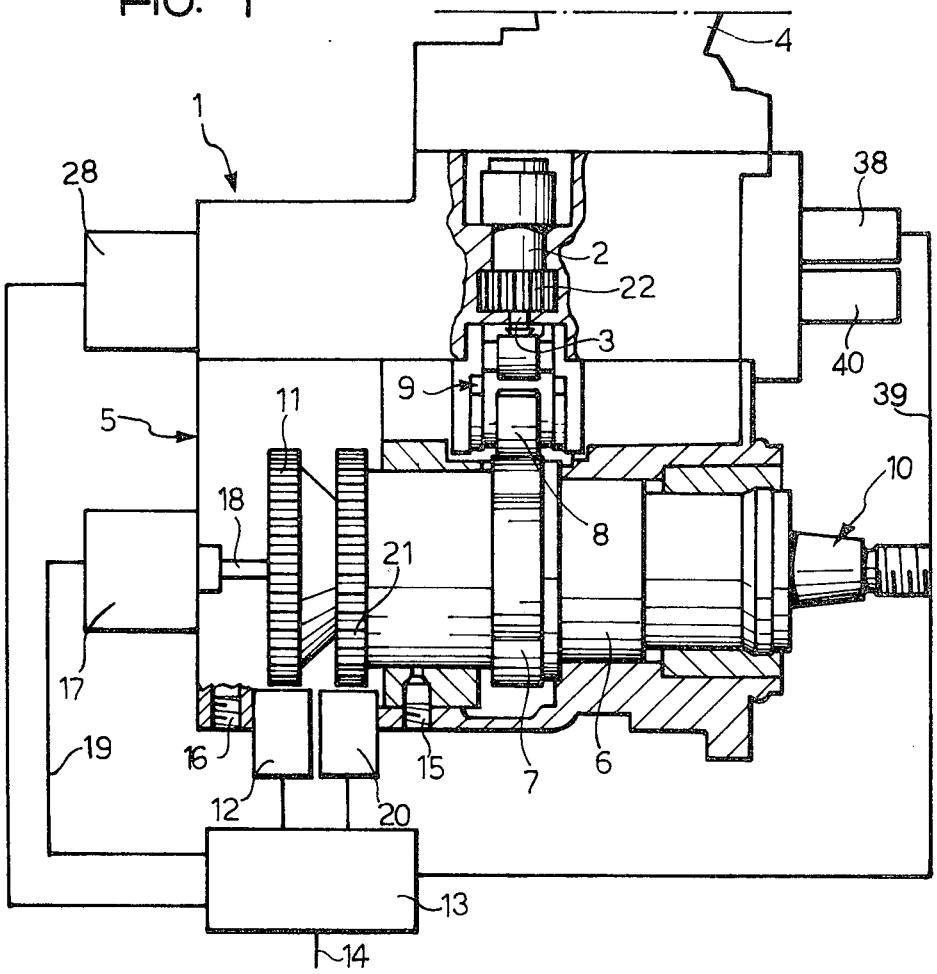
FIG. 1 is a diagrammatic side elevation, partly in longitudinal section, of an injection pump according to one embodiment of the invention.
Figure 3:
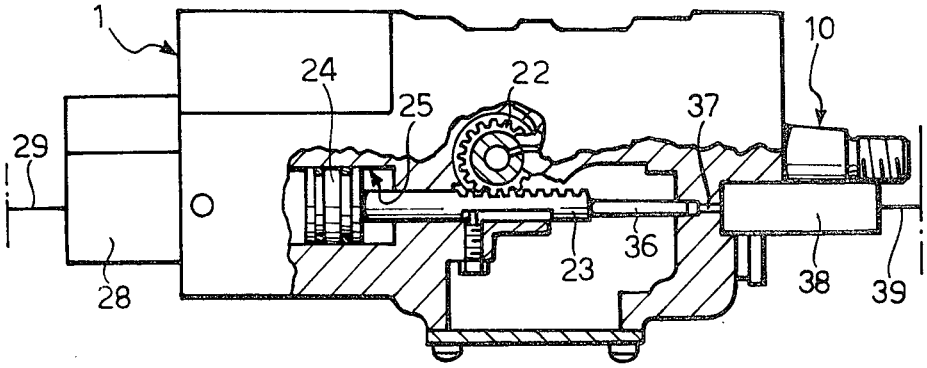
FIG. 3 is a diagrammatic plan view, partly in longitudinal section, of the pump shown in FIGS. 1 and 2.

In all the drawings corresponding component parts are designated by the same reference numbers.

The injection pump illustrated in the drawings is of the monoelement type with distributor. This consists of an upper body 1 provided with a cylindrical seating 2 for a pumping element 3, and surmounted by a distributor 4 of known type. The upper body 1 is fixed to a lower body 5 upon which is rotatably mounted a sleeve 6 provided with a multilobe cam 7. A cam follower roller rests against the periphery of the cam 7 and during the rotation of sleeve 6 causes axial reciprocation of the pumping element 3 to which it is connected by a mechanical coupling 9 of known type.

Inside the sleeve 6 a control shaft is rotatably mounted and has a drive member 10 adapted to be connected in use of the pump to the shaft of the engine on which the pump is mounted. This control shaft also carries a toothed wheel 11 adapted to cooperate with a rotational speed detector 12.

The detector 12 is connected in the circuit of the electronic control unit 13 to which are fed, via line 14, command signals dependent on the position of the accelerator pedal and on other factors. Inside the sleeve 6 there is also disposed a device of the type described in U.S. Pat. No. 3,603,112, for controlled variation of the injection advance by variation of the relative angular position of the control shaft and the sleeve 6. This device is actuated hydraulically by the lubricating oil of the engine to which the pump is fitted. For this purpose inlet and outlet ports 15 and 16 for the oil under pressure are machined into the lower body 5. The device is controlled by an electromagnet 17 having a displaceable core connected to a rod 18. The electromagnet 17 is energised by signals on a line 19 connected to the control unit 13. These signals are derived by the control unit 13 from the data received by the detector 12 and from a detector 20 cooperating with a toothed wheel 21 attached to the sleeve 6, as well as from other factors.

The pumping element 3 is coupled, by known method, to a pinion 22 rotatably supported in a recess of the body 1. The pinion 22 has external teeth meshing with a rack machined on a control rod 23. The control rod is machined in a single piece with a piston 24 sliding in a cylinder 25 machined directly into the upper body 1 and separated by a partition 26 from a cylindrical bore in which slides a distributor valve 27 fixed to the displaceable core of an electromagnet 28. The electromagnet 28 is energised by signals on a line 29 connected to the control unit 13. The cylindrical bore of the distributor valve 27 is connected by ducts 30 and 31 respectively to the respective chambers within the cylinder 21 on opposite sides of the piston 24, and is also connected to an exhaust port 32 and to a duct 33 which communicates with a feed chamber 34 connected to the injection pump. The chamber 34 is connected through a fuel inlet pipe 35, shown in broken outline in FIG. 2, to an auxiliary pump, PA, shown diagrammatically.

The control rod 23 carries a square section shaft 36 to which is fixed a stem 37 cooperating with a detector 38 responsive to the longitudinal position of the said stem 37 and, therefore, of the rod 23. The detector 38 is connected through a line 39 to the control unit 13.

A safety stop device 40 is adapted to engage in the direction of the arrows 41 with a pin 42 the free end of which faces one end of the control rod 23. The stop device 40 may be operated manually or by auxiliary means (not shown) when the fuel pressure in the feed chamber 34 falls below a given minimum.

Inside the electromagnet 28 is a spring (not shown) which biases the distributor valve 27 in the direction of the arrow 28*a* towards the position in which the duct 30 is connected to the exhaust port 32 and the duct 31 to the feed chamber 34 through the duct 33.

The ducts 30, 31, 33, as well as the channels that connect the distributor valve bore 27 with the exhaust port 32, are all machined into the upper body 1 of the pump.

Figure 4:
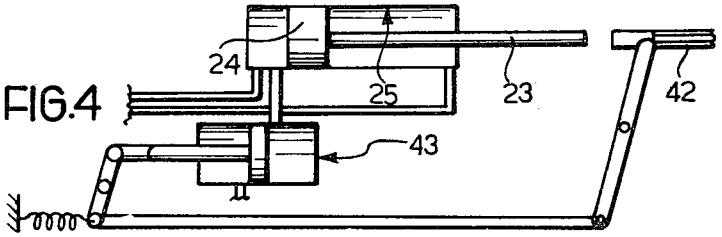
FIG. 4 is a diagrammatic sectional view illustrating some details of a pump according to a practical variant of the embodiment shown in FIGS. 1 to 3.

In order to facilitate the action of the safety stop device 40 the rod 42 may be connected (see FIG. 4) with an auxiliary valve 43, in such a way that the chamber of the actuator cylinder 25 between the piston 24 and the partition 26 is connected to the exhaust port from the time the stem 42 begins to advance.

OPERATION

Figure 2:
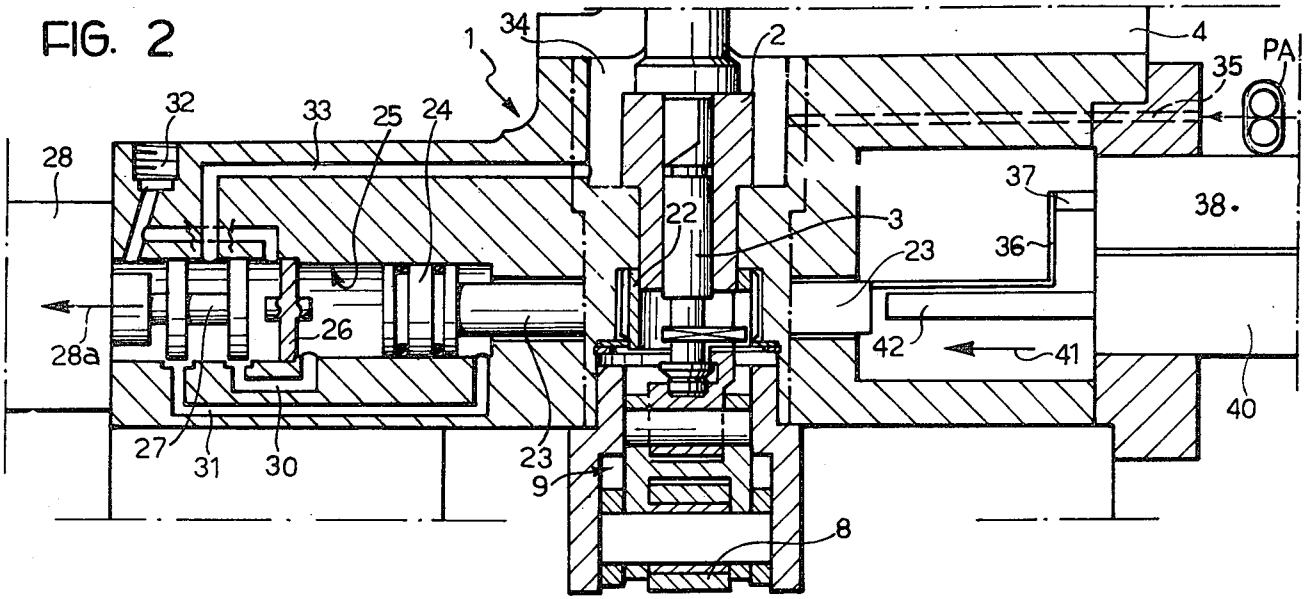
FIG. 2 is a longitudinal section, on an enlarged scale, showing the upper part of the pump illustrated in FIG. 1.

When the control signal delivered to the control unit 13 through the line 14 becomes equal to the signal provided by the detector 38 and supplied to the control unit 13 through the line 39, the distributor valve 27 occupies the position illustrated in FIG. 2, interrupting communication between the two chambers of the cylinder 25, situated on the opposite sides of the piston 24. Communication between the exhaust port 32 and the duct 33 connected to the feed chamber 34 is also interrupted. In moving the distributor valve 27 towards the left as shown in FIG. 2 the duct 31 is connected to the duct 33 and the duct 30 to the exhaust port. Under these conditions the piston 24 and the control rod 23 are displaced to the left (as viewed in FIG. 2) and the pump output is reduced. Such displacement reaches its limit when the signal from the detector 38 reaches a value equal to that of the command signal supplied to the control unit 13 via line 14. The reverse applies when the signal supplied to the electromagnet 28 via the line 29 has such a value that the distributor valve 27 moves towards the right (FIG. 2). The duct 31 then communicates with the exhaust port 32 and the duct 30 to the feed chamber 34 through the duct 33. This results in a displacement of the piston 24 and the control rod 23 away from the partition 26, and the injection pump output is increased. In this case also the displacement of the piston 24 will reach its limit when the signal transmitted from the detector 38 equals that arriving at the control unit 13 through the line 14.

Should the fuel pressure in the feed chamber 34 fall for any reason it is possible to bring the safety stop device 40 into operation with the effect of immediately reducing the injection pump output to zero and thus avoiding the continued feeding of fuel to the engine, with the risk of causing it to continue rotating.

With the principle of the invention unchanged, practical details thereof may be widely varied from the embodiment which has been described and illustrated merely by way of example, without thereby departing from the scope of the invention.

For example, in the case where the injection pump comprises further pumping elements arranged in line and the control rod therefore has a considerable length, the end of such control rod opposite the plunger sliding in the actuator cylinder may be supported in a guide machined into the pump body. This guide may be easily arranged coaxially with respect of the actuator cylinder axis inasmuch as this latter is also machined into the same upper body of the pump. Variation of the fuel injection advance and variation of the level displacement of the electromagnet may also be controlled by a centrifugal regulator, as described, for example, in U.S. Pat. No. 3,603,112.

What is claimed is:

1. Injection pump for diesel engines of the type comprising a pump body having a fuel inlet and a seating in which a rotatably adjustable pumping element is slidable, an auxiliary pump, a feed chamber operatively associated with said seating and adapted to receive fuel under pressure from said auxiliary pump, a control rod for regulating rotation of said pumping element, proportional electrohydraulic actuator means carried on the pump body for displacing the control rod longitudinally, said actuator means including an actuator cylinder, a distributor valve controlling the feed and exhaust of the fluid under pressure selectively to and from the actuator cylinder, an electromagnet controlling said distributor valve, a piston slidable in said cylinder and connected to the control rod, wherein the improvement consists in that the actuator cylinder and the seating of the distributor valve are machined directly in the pump body in which the said at least one pumping element seating is formed, and in that the control rod is rigidly attached to the piston of the actuator cylinder.

2. The injection pump defined in claim 1, wherein the distributor valve is supplied with fuel under pressure from the pump feed chamber.

3. The injection pump defined in claim 2, including conduits machined in the pump body and connecting the distributor valve with the feed chamber, with the fuel inlet and with the actuator cylinder pump body.

4. The injection pump defined in claim 1, wherein the actuator cylinder forms an extension of the distributor valve seating and including partition wall means separating the actuator cylinder from the valve seating.

5. The injection pump defined in claim 1, including a seating coaxial with the said cylinder and machined in the pump body, the end portion of the control rod opposite the end of the rod which is attached to the piston of the actuator cylinder being guided in said seating.

6. The injection pump as defined in claim 1, wherein the pump includes a safety stop device adapted to act directly on the control rod to move it to a position corresponding to zero output of the pump, and also includes means for exhausting, upon operation of said stop device, that chamber of the actuator cylinder which is under pressure, relieving the force on the piston which opposes the said displacement of the control rod.

* * * * *